US008787780B2

(12) United States Patent
Shimura et al.

(10) Patent No.: US 8,787,780 B2
(45) Date of Patent: Jul. 22, 2014

(54) IMAGE FORMING APPARATUS HAVING A FIXING UNIT COMPRISING A CURRENT DETECTION UNIT

(75) Inventors: Yasuhiro Shimura, Yokohama (JP); Atsushi Kawarago, Suntou-gun (JP); Yuta Hojo, Suntou-gun (JP); Kei Sato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/309,431

(22) Filed: Dec. 1, 2011

(65) Prior Publication Data

US 2012/0148273 A1 Jun. 14, 2012

(30) Foreign Application Priority Data

Dec. 8, 2010 (JP) ..... 2010-273894

(51) Int. Cl.
*G03G 15/20* (2006.01)

(52) U.S. Cl.
USPC ..... 399/33

(58) Field of Classification Search
USPC ..... 399/33
See application file for complete search history.

(56) References Cited

U.S. PATENT DOCUMENTS

| | | | | |
|---|---|---|---|---|
| 5,229,577 | A | 7/1993 | Matsuura et al. | |
| 6,870,140 | B2 * | 3/2005 | Cook et al. | 219/486 |
| 2005/0095021 | A1 * | 5/2005 | Fujiwara | 399/33 |
| 2006/0018676 | A1 * | 1/2006 | Ishii | 399/33 |
| 2009/0003868 | A1 * | 1/2009 | Namiki et al. | 399/69 |
| 2010/0104297 | A1 * | 4/2010 | Hata | 399/33 |
| 2011/0280596 | A1 * | 11/2011 | Shimura | 399/33 |
| 2011/0280597 | A1 * | 11/2011 | Shimura et al. | 399/37 |
| 2012/0155895 | A1 * | 6/2012 | Shimura | 399/33 |

FOREIGN PATENT DOCUMENTS

| | | | | |
|---|---|---|---|---|
| JP | 07-121055 A | | 5/1995 | |
| JP | 07-199702 A | | 8/1995 | |
| JP | 07199702 A | * | 8/1995 | G03G 15/20 |
| JP | 3919670 B2 | | 5/2007 | |
| JP | 2007-212503 A | | 8/2007 | |
| JP | 2007212503 A | * | 8/2007 | |
| JP | 2010-199066 A | | 9/2010 | |

* cited by examiner

*Primary Examiner* — David Gray
*Assistant Examiner* — Tyler Hardman
(74) *Attorney, Agent, or Firm* — Canon USA Inc IP Division

(57) ABSTRACT

An apparatus is capable of switching between a mode in which a first resistance heating element and a second resistance heating element are connected in series and a mode in which they are connected in parallel. When a temperature increase rate detected by a temperature detection unit is smaller than a threshold rate although a current detected by a current detection unit is greater than a threshold current, a notification of a failure is issued.

8 Claims, 12 Drawing Sheets

IMAGE FORMING APPARATUS HAVING A FIXING UNIT COMPRISING A CURRENT DETECTION UNIT

BACKGROUND OF THE INVENTION

1. Field of the Invention

One of the aspects of the present invention relates to an image forming apparatus such as a copying machine, a laser beam printer and the like, and for example, to an image forming apparatus including an endless belt, a heater in contact with an inner surface of the endless belt, and a nip forming element that forms a fixing nip together with the heater via the endless belt.

2. Description of the Related Art

When an image forming apparatus is originally designed for use in an area where a commercial power supply has a voltage in a 100-V range (for example, 100 V to 127 V), if this image forming apparatus is used in an area where a commercial power supply with a voltage in a 200-V range (for example, 200 V to 240 V) is supplied, maximum electric power available to a heater of a fixing unit increases by a factor of 4. The increase in maximum available power to the heater can cause a significant increase in a high-frequency current or flicker generated during a process of controlling power of the heater by means of a phase control, a wavenumber control, etc. Besides, if thermal runaway occurs in the fixing unit, electric power associated with the thermal runaway is 4 times greater, and thus circuits used need to be capable of quickly responding. Therefore, the most common way to allow a single image forming apparatus to be used in both 100-V and 200-V power supply areas is to select a heater with a proper resistance depending on the area and install the selected heater.

A technique has been proposed to realize an apparatus for universal use in both 100-V and 200-V commercial power supply areas by switching the resistance of the heater using a relay or other switching devices. More specifically, for example, Japanese Patent Laid-Open No. 7-199702 discloses an apparatus in which first and second resistance heating elements are formed on a heater substrate, and the apparatus is adapted to be capable of switching between a first operation mode in which the first and second resistance heating elements are connected in series and a second operation mode in which the first and second resistance heating elements are connected in parallel whereby it is possible to switch the resistance of the heater depending on the commercial power supply voltage such that the apparatus can be used regardless of where the commercial power supply voltage is 100 V or 200 V. In the technique in which the first and second resistance heating elements are connected in series or in parallel depending on the commercial power supply voltage, it is possible to switch the resistance of the heater without changing the heating area of the heater. In other words, the two resistance heating elements generate heat regardless of whether the apparatus is used in the 100-V area or 200-V area, and thus a fixing nip has a constant temperature distribution in a recording sheet conveying direction regardless of the area in which the apparatus is used. As a result, the performance of fixing toner images does not depend on the area in which the apparatus is used.

However, in this technique, if a failure occurs in a relay for switching the resistance of the heater, a situation can occur in which electric power is supplied only to one of the two resistance heating elements. Hereinafter, such a state will be referred to as a partially powered state. The partially powered state can produce a problem such as a reduction in durability life of the fixing unit or degradation in the performance of fixing compared with that in the normal state. Thus, it is necessary to detect whether the apparatus is in the partially powered state.

SUMMARY OF THE INVENTION

One of the aspects of the present invention provides a high-reliability apparatus with a simple configuration capable of switching resistance of a heater and capable of detecting whether the apparatus is in the partially powered state.

In an aspect, the present invention provides an image forming apparatus including an image forming unit configured to form an image on a recording sheet, and a fixing unit comprising an endless belt, a heater including a first resistance heating element and a second resistance heating element, the first and second resistance heating elements formed on a substrate and being in contact with an inner surface of the endless belt, a nip forming element that forms, together with the heater via the endless belt, a fixing nip for nipping and conveying a recording sheet having an image formed thereon, and a temperature detection unit that detects a temperature of the heater. The fixing unit is capable of switching between a first operation mode in which the first resistance heating element and the second resistance heating element are connected in series and a second operation mode in which the first resistance heating element and the second resistance heating element are connected in parallel. The image forming apparatus further includes a current detection unit disposed in either a first conduction path for supplying electric power to the first resistance heating element or a second conduction path for supplying electric power to the second resistance heating element, and if a temperature increase rate detected by the temperature detection unit is less than a threshold rate although a current detected by the current detection unit is greater than a threshold current, a notification of a failure is issued or a driving operation of the apparatus is stopped.

Further features of the present invention will become apparent from the following description of exemplary embodiments with reference to the attached drawings.

DESCRIPTION OF THE EMBODIMENTS

Figure 12:
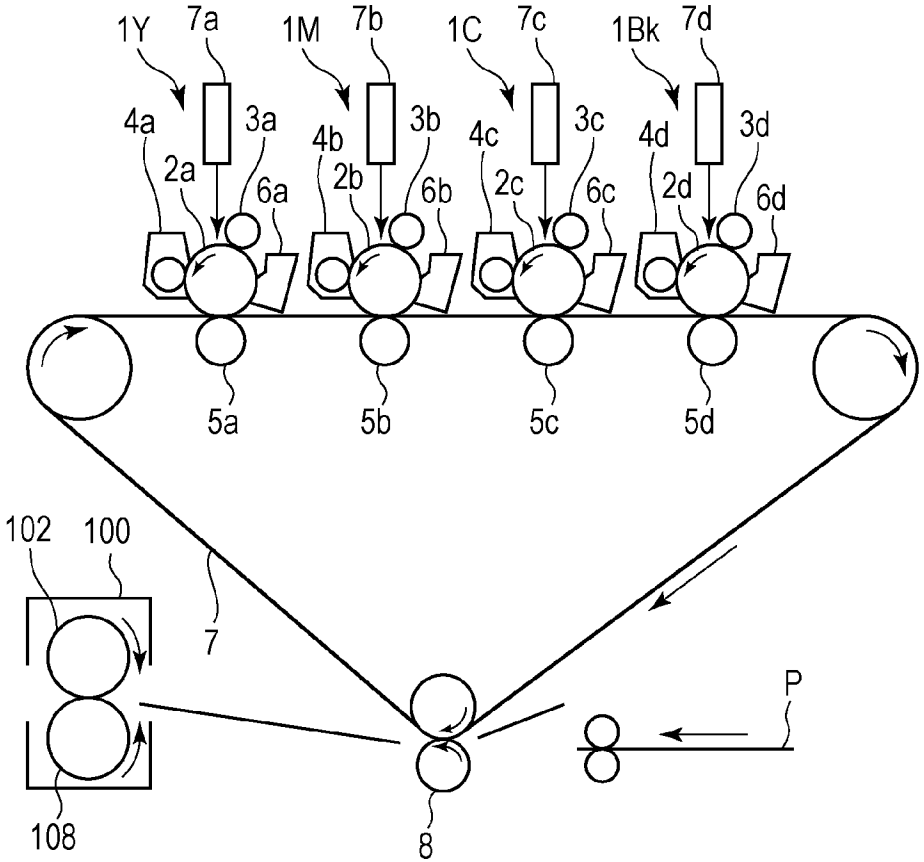
FIG. 12 is a schematic diagram of an image forming apparatus.

FIG. 12 a cross-sectional view of an image forming apparatus (a full color printer in this example) using electrophotographic recording technology. An image forming unit is for forming a toner image on a recording sheet P and includes four image forming stations (1Y, 1M, 1C, and 1Bk). Each image forming station includes a photosensitive element 2 (2*a*, 2*b*, 2*c*, or 2*d*), a charging unit 3 (3*a*, 3*b*, 3*c*, or 3*d*), a developing unit 4 (4*a*, 4*b*, 4*c*, or 4*d*), a transfer unit 5 (5*a*, 5*b*, 5*c*, or 5*d*), and a cleaner 6 (6*a*, 6*b*, 6*c*, or 6*d*) for cleaning the photosensitive element. The image forming unit further includes a belt 7 for conveying a toner image formed thereon, and a secondary transfer roller 8 for transferring the toner image from the belt 7 to the recording sheet P. The image forming unit of this type operates in a known manner, and thus a description thereof is omitted. After an unfixed toner image is transferred to the recording sheet P by the image forming unit, the recording sheet P is sent to a fixing unit 100 and the toner image on the recording sheet P is fixed by heating.

Figure 1:
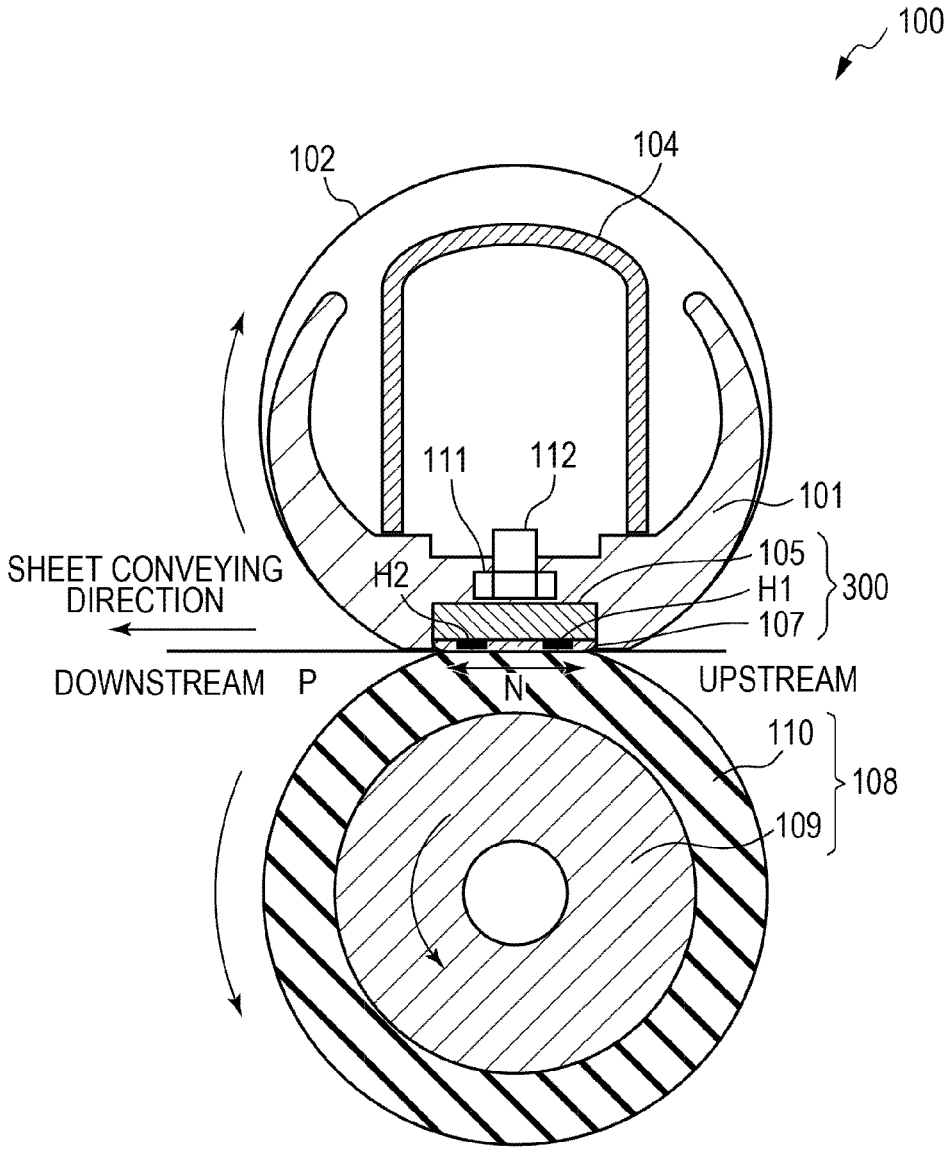
FIG. 1 is a cross-sectional view of a fixing apparatus (fixing unit).

FIG. 1 a cross-sectional view of the fixing apparatus (fixing unit) 100. The fixing apparatus 100 includes a roll-shaped film (endless belt) 102, a heater 300 located in contact with the inner surface of the film 102, and a pressure roller (nip forming element) 108 forming a fixing nip N together with the heater 300 via the film 102. A base layer of the film may be made of a heat-resistant resin such as polyimide or a metal such as stainless steel. The pressure roller 108 includes a core metal 109 made of iron, aluminum, or a similar material, and an elastic layer 110 made of silicone rubber or a similar material. The heater 300 is held by a supporting element 101 made of a heat-resistant resin. The supporting element 101 also functions as a guide for the rotation of the film 102. The pressure roller 108 is driven by a motor (not shown) to rotate in a direction represented by an arrow. When the pressure roller 108 rotates, the film 102 rotates following the rotation of the pressure roller 108.

The heater 300 includes a heater substrate 105 made of ceramic, a resistance heating element H1 (first resistance heating element) and a resistance heating element H2 (second resistance heating element) both disposed on the heater substrate 105, and a surface protective layer 107 made of an insulating material (glass, in the present embodiment) covering the resistance heating elements H1 and H2. A temperature detecting device (temperature detection unit) 111 such as a thermistor is in contact with the back surface of the heater substrate 105 in an area over which a sheet with a minimum allowable size (110 mm (the width of an envelope DL) in the present embodiment) set defined for the specific printer passes according to temperature detected by the temperature detecting device 111, electric power supplied from the commercial AC power supply to the heater is controlled. A recording sheet (paper) P having an unfixed toner image formed thereon is fixed by heating when the recording sheet P is being nipped and conveyed by a fixing nip N. A temperature adjusting element 112 such as a thermo switch is also in contact with the back surface of the heater substrate 105 to cut off a power supply line to the heater when an abnormal increase in temperate of the heater occurs. Note that the temperature adjusting element 112 is also in contact with the area over which a minimum-sized sheet passes, as with the temperature detecting device 111. A metal stay 104 is provided to apply a pressure of a spring (not shown) to the supporting element 101.

First Embodiment

Figure 2:
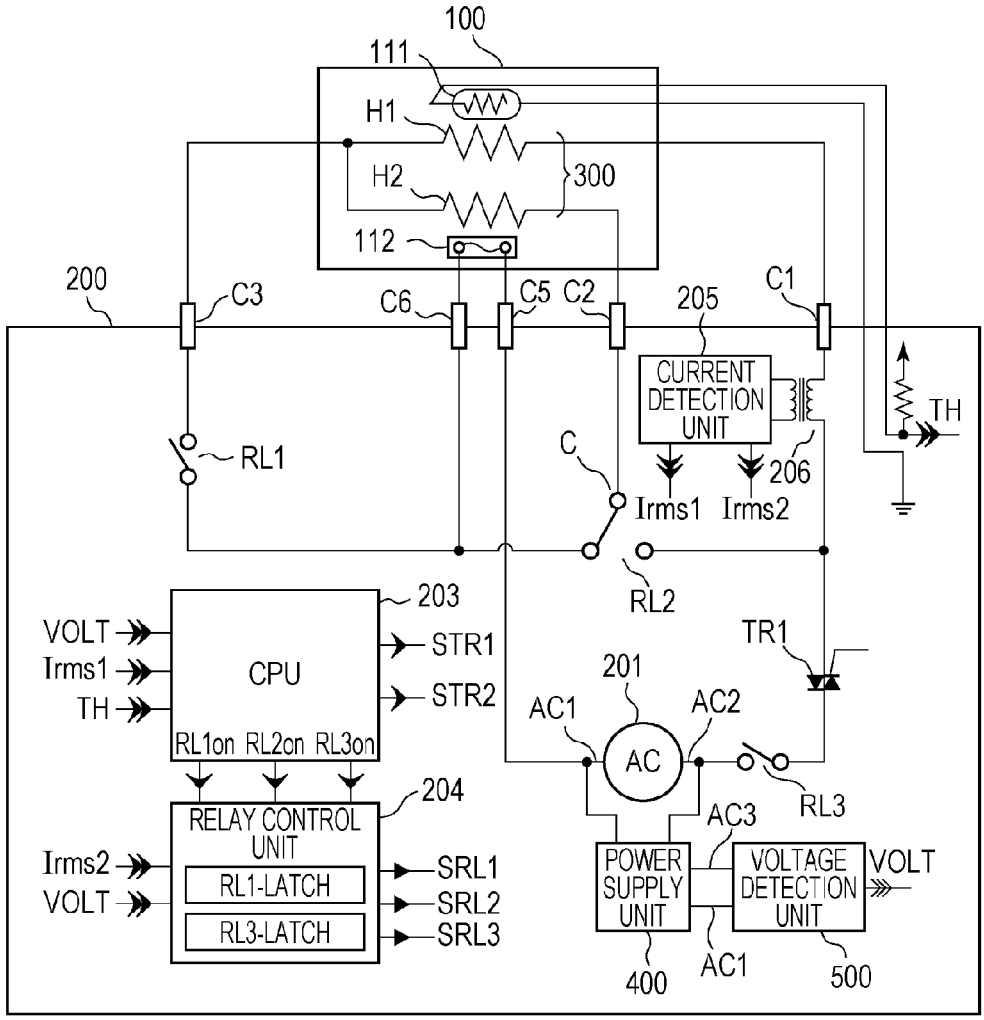
FIG. 2 is a diagram illustrating a heater control circuit according to an embodiment of the invention.

FIG. 2 is a circuit block diagram of a control circuit 200 for controlling the heater 300 according to a first embodiment of the invention. Connectors C1, C2, C3, C5, and C6 are provided for connecting the control circuit 200 to the fixing apparatus 100. Electric power is supplied from a commercial AC power supply 201 to the heater 300. The electric power to the heater is controlled by turning on/off a triac TR1. The triac TR1 operates according to a signal (a heater driving signal) STR1 supplied from a CPU 203. The temperature detecting device 111 detects temperature by detecting a resistance-divided voltage of a pull-up resistor. The detected temperature is input as a TH signal to the CPU 203. Based on the temperature detected by the temperature detecting device 111 and a set temperature of the heater 300, the CPU 203 performs an internal process to calculate electric power to supply to the heater 300, for example, by means of PI control. The CPU 203 further calculates control parameters such as a phase angle (in phase control) or a wavenumber (in wavenumber control) and thereby controls the triac TR1.

Next, a voltage detection unit and a relay control unit are explained below. In a power off state, relays RL1, RL2, and RL3 are in such states as shown in FIG. 2. Relays RL1 and RL2 function as a series-parallel switching unit. The relay RL1 is of a normally open type (serving as a first switch unit). The relay RL2 is of a break-before-make type (serving as a second switch unit) having a common contact denoted by a symbol "c" in FIG. 2.

A voltage detection unit 500 detects a voltage applied between two output terminals AC1 and AC2 (AC3) of an AC power supply 201. The voltage detection unit 500 determines whether the power supply voltage is in a range of a 100-V commercial power supply system (for example, 100 V to 127 V) or in a range of a 200-V commercial power supply system (for example, 200 V to 240 V), and the voltage detection unit 500 outputs a signal VOLT indicating the result of the voltage detection to the CPU 203 and a relay control unit 204. In a case where the power supply voltage is in the 200-V range, the signal VOLT is in a low state. The details of the voltage detection unit 500 will be described later with reference to FIG. 5.

In a case where the voltage detected by the voltage detection unit 500 is in the 200-V power system range, the relay control unit 204 operates the RL1-latch to turn the signal SRL1 into a low state thereby maintaining the relay RL1 in the OFF state. Once the RL1-latch operates, the relay RL1 remains in the OFF state even when a signal RL1*on* output from the CPU 203 turns into a high state. In the relay control unit 204, the latch circuit described above may be replaced with another HW circuit that maintains the relay RL1 in the OFF state as long as the signal VOLT is in the low state. According to the detected voltage, the CPU 203 turns the signal RL2 on into a low state to maintain the relay RL2 in the OFF state.

If the CPU 203 further turns a signal RL3*on* into a high state, the relay control unit 204 turns a signal SRL3 into a high state to turn the relay RL3 into an ON state. In this state, the first resistance heating element H1 is connected in series to the second resistance heating element H2, and thus the heater 300 is switched into a high resistance state.

On the other hand, in a case where the voltage detected by the voltage detection unit 500 is in the 100-V power system range, the CPU 203 turns the signal RL1*on* into a high state. In response, the relay control unit 204 turns the signal SRL1 into a high state to turn on the relay RL1. Furthermore, according to the signal VOLT, the CPU 203 turns the signal RL2*on* into a high state, which causes the signal SRL2 to turn into a high state and thus causes the relay RL2 to turn into an ON state (in which a contact on the right-hand side is connected). The CPU 203 further turns the signal RL3 on into a high state. In response, the relay control unit 204 turns the signal SRL3 into a high state to turn on the relay RL3. As a result, the fixing apparatus 100 comes to be capable of receiving electric power in such a state that the first resistance heating element H1 and the second resistance heating element H2 are connected in parallel and thus the heater 300 has a low resistance. As described above, the image forming apparatus includes the voltage detection unit to detect the voltage of the commercial power supply and, depending on the voltage detected by the voltage detection unit, the image forming apparatus automatically switches the connection state between the state in which the two resistance heating elements are connected in series and the state in which the two resistance heating elements are connected in parallel.

Next, a current detection unit 205 is described below. The current detection unit 205 detects, via a current transformer 206, the effective value of a current flowing through a path on a primary side of the current transformer 206. Note that the current detection unit 205 is disposed only in either a first conduction path for supplying electric power to the first resistance heating element H1 or a second conduction path for supplying electric power to the second resistance heating element H2. In the present example, the current detection unit 205 is disposed in the first conduction path for supplying electric power to the first resistance heating element H1.

The current detection unit 205 outputs Irms1 and Irms2, where Irms1 indicates the square of the effective current value in each period of the commercial power supply frequency and Irms2 indicates the moving average of Irms1. In accordance with Irms1, the CPU 203 detects the effective value of the current in each period of the commercial power supply frequency. The current detection unit 205 may be configured, for example, as disclosed in Japanese Patent Laid-Open No. 2007-212503. Irms2 is supplied to the relay control unit 204. If an overcurrent flows through the current transformer 206 and Irms2 becomes greater than a predetermined threshold current value, then the relay control unit 204 operates the latches corresponding to the relays RL1 and RL3 such that the relays RL1 and RL3 are maintained in the OFF state thereby cutting off the electric power to the fixing apparatus 100.

Figure 3A:
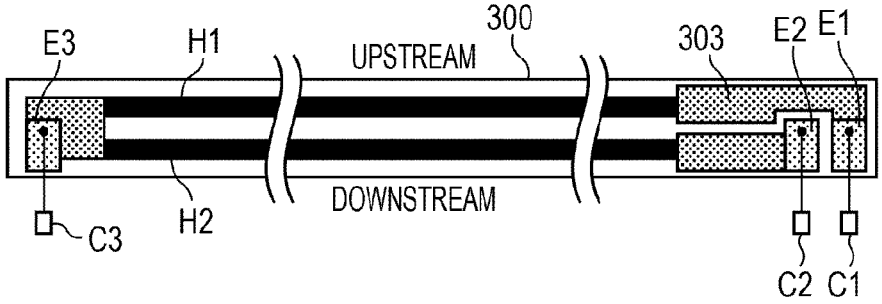
FIG. 3A is a diagram illustrating an example of a structure of a heater according to an embodiment of the invention.
Figure 3B:
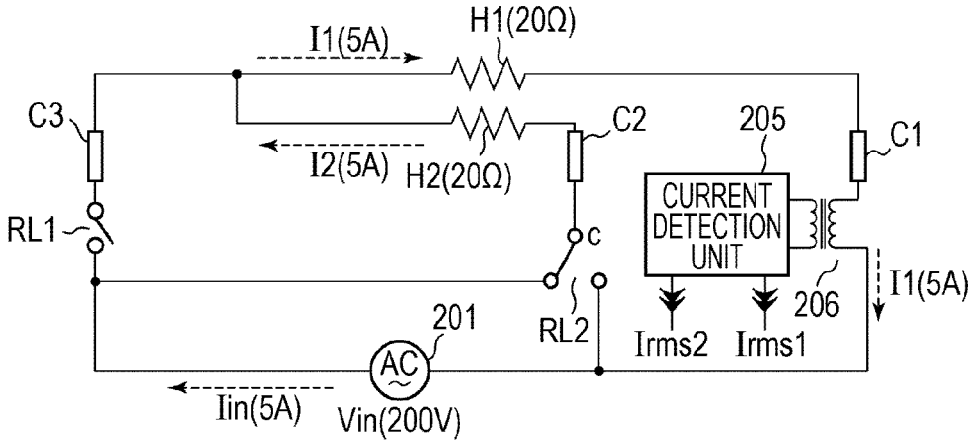
FIGS. 3B and 3C are diagrams illustrating two operation modes.
Figure 3C:
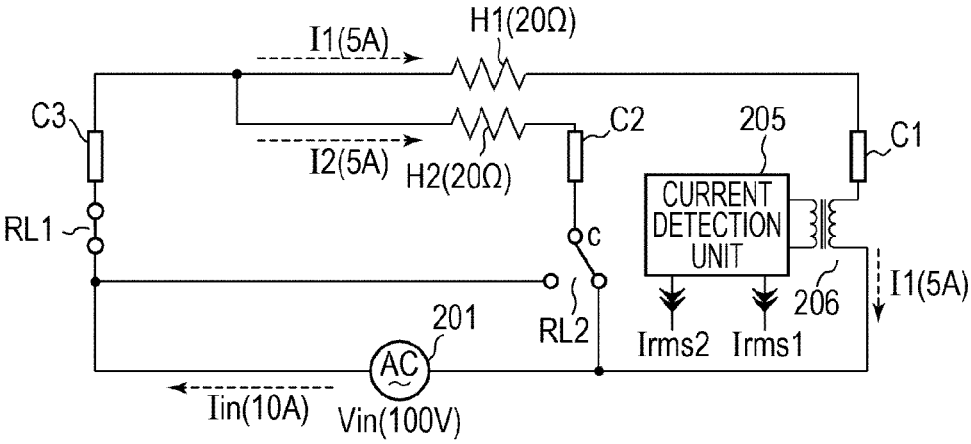

FIG. 3A illustrates the heater 300 configured according to the present embodiment. FIG. 3B illustrates a first operation mode of the heater 300 (in which resistance heating elements are connected in series for use in a 200-V area). FIG. 3C illustrates a second operation mode of the heater 300 (in which resistance heating elements are connected in parallel for use in a 100-V area).

In the example shown in FIG. 3A, the heater 300 includes a heating resistor patterns (resistance heating elements H1 and H2), conductor patterns 303, and electrodes E1, E2, and E3, which are all formed on a heater substrate 105. In FIG. 3A, connections to connectors shown in FIG. 2 are also shown to illustrate a manner in which the heater 300 is connected to the control circuit 200 shown in FIG. 2. The first resistance heating element H1 is disposed on an upstream side in a sheet conveying direction, and electric power is supplied to the first resistance heating element H1 via the electrode E1 (first electrode) and the electrode E3 (third electrode). The second resistance heating element H2 is disposed on a downstream side in the sheet conveying direction, and electric power is supplied to the second resistance heating element H2 via the electrode E2 (second electrode, common contact) and the electrode E3. The electrode E1 is connected to the connector C1, the electrode E2 is connected to the connector C2, and the electrode E3 is connected to the connector C3.

FIG. 3B illustrates the first operation mode employed when the power supply voltage is in the 200-V power supply system range. In this mode, the first resistance heating element and the second resistance heating element are connected in series. In the following explanation, it is assumed by way of example that the resistance heating element H1 and the resistance heating element H2 each have resistance of 20Ω. In the first operation mode, because the two resistance heating elements each having resistance of 20Ω are connected in series, the resultant resistance of the heater 300 is 40Ω. The power supply voltage is equal to 200 V, and thus a current of 5 A is supplied to the heater 300 and electric power is equal to 1000 W. The current I1 flowing through the first resistance heating element and the current I2 flowing through the second resistance heating element are both equal to 5 A. The current detection unit 205 detects a current equal to the current I1=5 A.

FIG. 3C illustrates the second operation mode employed when the power supply voltage is in the 100-V power supply system range. In this mode, the first resistance heating element and the second resistance heating element are connected in parallel. In this second operation mode, because the two resistance heating elements each having resistance of 20Ω are connected in parallel, the resultant resistance of the heater 300 is 10Ω. The power supply voltage is equal to 100 V, and thus the current supplied to the heater 300 is equal to 10 A and the electric power is equal to 1000 W. The current I1 flowing through the first resistance heating element and the current I2 flowing through the second resistance heating element are both equal to 5 A. The current detection unit 205 detects a current equal to the current I1=5 A.

A comparison is given below as to the current and electric power supplied to the heater between the operations modes shown in FIGS. 3B and 3C. In the case where the current I1 is detected, when I1=5 A is detected in the first operation mode shown in FIG. 3B, the electric power supplied to the heater is equal to 1000 W, while when I1=5 A is detected in the second operation mode shown in FIG. 3C, the electric power supplied to the heater is also equal to 1000 W. That is, when the current I1 is detected, the detected current is proportional to the electric power supplied to the heater 300 regardless of whether the heater 300 operates in the first or second operation mode.

A current limit may be set such that the electric power supplied to the heater is limited to 1000 W, as described below. For example, in the case where the current I1 is detected, if the current is limited to 5 A regardless of the operation mode of the heater 300, the electric power supplied to the heater 300 is limited to 1000 W. Japanese Patent Publication No. 3919670 discloses an example of a method of controlling the electric power to be lower than a predetermined value based on a detected current. A description is given below as to a case in which I1 is controlled so as to be equal to or lower than 5 A in a normal state and 6 A is set as an abnormal current. In the normal state, I1 is controlled to be equal to or lower than 5 A based on the signal Irms1. If it becomes impossible to correctly control the electric power due to a failure of the triac TR1 or for other reasons and if an abnormal current equal to or greater than 6 A is detected, the signal Irms2 goes into a high state. In response, the relay control unit 204 turns off the relays RL1 and RL3 to cut off the supply of the electric power to the fixing apparatus 100.

Figure 4:
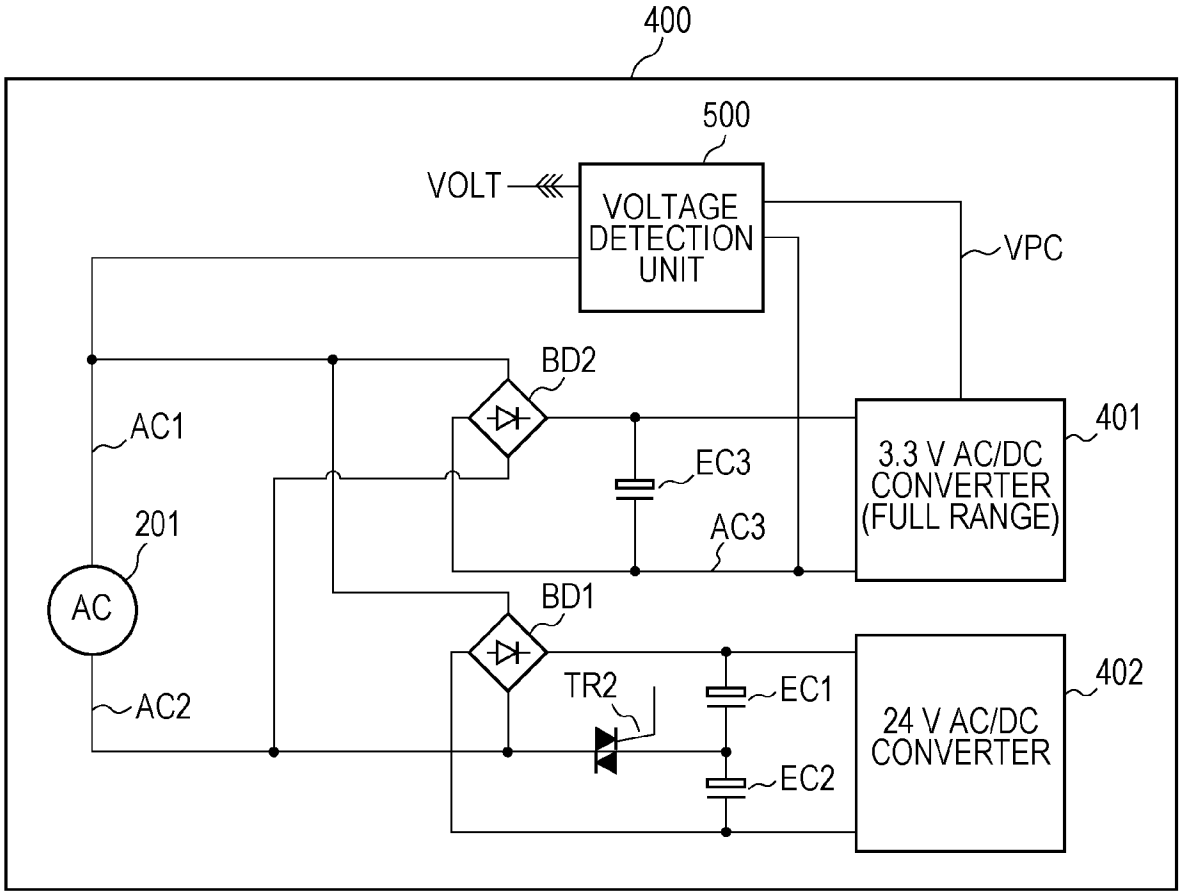
FIG. 4 is a diagram illustrating a power supply unit configured to supply electric power to a fixing apparatus.

FIG. 4 illustrates a power supply unit configured to supply electric power to the fixing apparatus. The power supply unit 400 includes an AC/DC converter 401 for 3.3 V and an AC/DC converter 402 for 24 V. The AC/DC converter 402 for 24 V is described below. A bridge diode BD1 is for rectifying the AC power supply 201. Electrolytic capacitors EC1 and EC2 are for smoothing. In a full-wave rectification mode, the triac TR2 is in an OFF state, and thus a voltage rectified by the bridge diode BD1 is applied to a series connection of EC1 and EC2. In a voltage doubler rectification mode, the triac TR2 is in an ON state. In this case, a positive-phase half wave is used to charge the electrolytic capacitor EC1, while a negative-phase half wave is used to charge the electrolytic capacitor EC2. In each case, the peak of the half wave is held and thus a voltage substantially twice the voltage in the full-wave rectification mode is applied to the AC/DC converter 402 for 24V. In a case where the determination performed by the CPU 203 according to the voltage (the signal VOLT) detected by the voltage detection unit 500 is that the commercial power supply voltage is in the 200 V power system range, the signal STR2 is turned into a low state to turn off the triac TR2 such that the 24V converter 402 operates in the full-wave rectification mode.

On the other hand, in the case where the CPU 203 determines that the commercial power supply voltage is in the 100 V power system range, the CPU 203 turns the signal STR2 into a high state to turn on the triac TR2 such that the 24V converter 402 operates in the voltage doubler rectification mode. The AC/DC converter 401 for 3.3 V operates in a full-range mode regardless of whether the power supply voltage is in the 100-V range (for example 100 V to 127 V) or the 200-V range (for example, 200 V to 240 V). The AC/DC converter 401 includes a bridge diode BD2 for rectifying the AC power supply 201 and an electrolytic capacitor EC3 for smoothing. The AC/DC converter 401 for 3.3 V is used as a power supply to drive relatively small loads such as a CPU, a sensor, etc., and thus it is possible to easily design the full-range converter even when the operation mode is not switched between the voltage doubler rectification and full-wave rectification. In contrast, the AC/DC converter 402 for 24 V in the present embodiment is used to drive large loads such as a motor, and thus it needs to output large electric power. In the AC/DC converter capable of outputting high electric power and having no PFC (Power Factor Control) circuit, it can be difficult to achieve a full-range operation without switching between the voltage doubler rectification and the full-wave rectification. In the present embodiment, in view of the above, the 24V converter 402 is configured to be capable of switching between the voltage doubler rectification and the full-wave rectification.

The voltage detection unit 500 detects a voltage appearing between AC1 and AC3 after the AC power supply 201 is half-wave rectified by the bridge diode BD2. An auxiliary winding voltage (a DC voltage with reference to AC3) is output from the 3.3-V AC/DC converter 401 and is applied as a power supply voltage VPC to the voltage detection unit 500.

Figure 5:
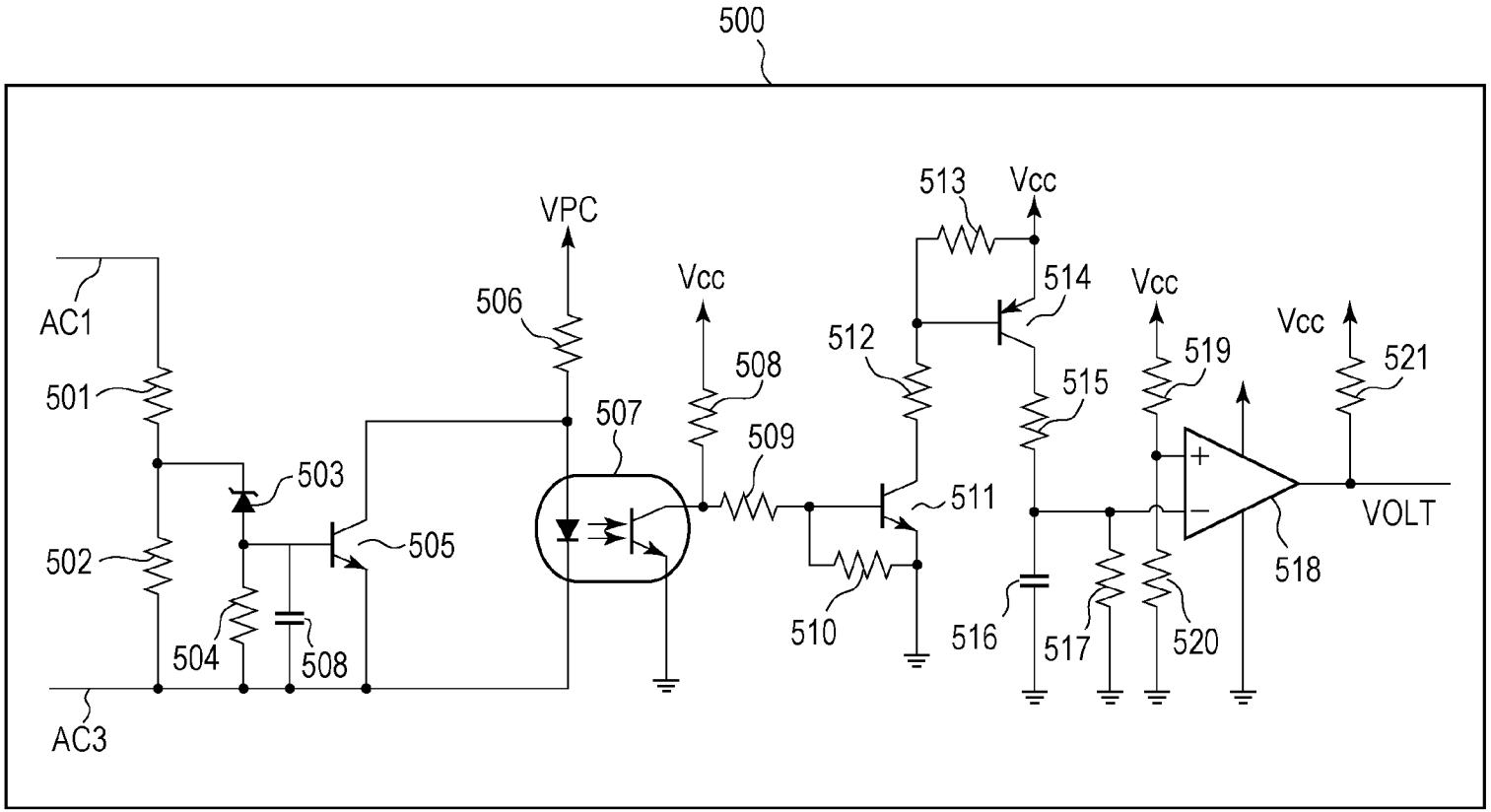
FIG. 5 is a circuit diagram of a voltage detection unit according to an embodiment of the invention.

FIG. 5 is a circuit diagram of the voltage detection unit 500. The voltage detection unit 500 is capable of detecting whether the commercial power supply voltage is in the 100-V range or the 200-V range, based on the voltage between AC1 and AC3, as described below. In a case where the voltage of AC1 is higher than that of AC2, the AC1-to-AC3 voltage half-wave rectified by the bridge diode BD2 is applied to the voltage detection unit 500. If the AC1-to-AC3 voltage becomes greater than a threshold voltage value, a voltage obtained via a resistance voltage divider including a resistor 501 and a resistor 502 becomes higher than a Zener voltage of a Zener diode 503. As a result, a voltage is applied to a resistor 504, and thus an npn-type bipolar transistor 505 turns on. Before the npn-type bipolar transistor 505 turns on, a light emitting diode located on a primary side of a photocoupler 507 is in a light emitting state in which a current is supplied from the power supply VPC via a resistor 506 to the light emitting diode. However, the turning-on of the npn-type bipolar transistor 505 causes the light emitting diode on the primary side of the photocoupler 507 to be shunted with the npn-type bipolar transistor 505 in the ON-state, and thus the light emitting diode of the photocoupler 507 goes into a non-light emitting state. A capacitor 508 is provided for dealing with noise. When the light emitting diode of the photocoupler 507 turns into the non-light emitting state, a transistor on a secondary side of the photocoupler 507 turns off. As a result, a voltage is applied from a power supply Vcc via a resistor 508 to a resistor 509 and a resistor 510, and thus an npn-type bipolar transistor 511 turns on. The turning-on of the transistor 511 causes a base current to flow from the power supply Vcc via a resistor 513 and a resistor 512, and a pnp transistor 514 turns on.

Thus, when the voltage between AC1 and AC3 becomes higher than the threshold voltage value, a charging current flows into a capacitor 516 from the power supply Vcc via a resistor 515. Note that a resistor 517 is for discharging. If the voltage between AC1 and AC3 becomes further greater and the light emitting diode located on the primary side of the photocoupler 507 is in the OFF state for a longer time, then the charging current flows into the capacitor 516 for a longer time and thus the voltage across the capacitor 516 increases. If the voltage across the capacitor 516 becomes greater than a reference voltage given as a resistor-divided voltage via a resistor 519 and a resistor 520 and applied to a comparator 518, a voltage VOLT output from the comparator 518 turns into a low state. Note that a resistor 521 serves as a pull-up resistor.

Figure 6A:
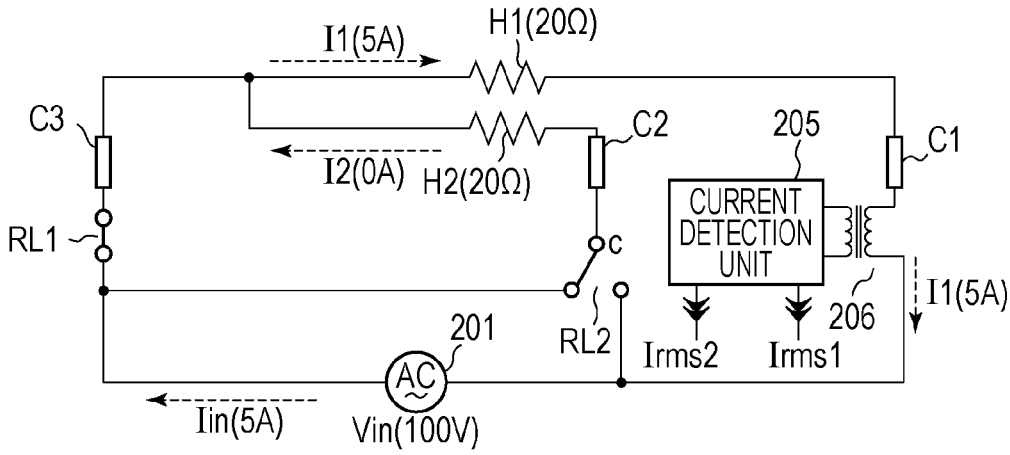
FIGS. 6A and 6B are diagrams illustrating partially powered states.
Figure 6B:
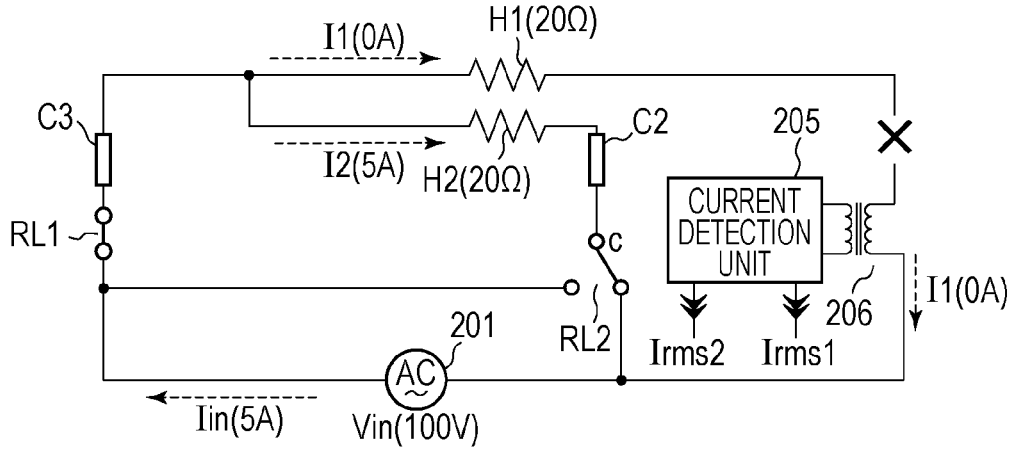

Referring to FIGS. 6A and 6B, partially powered states of the heater 300 used in the present embodiment are described below.

FIG. 6A illustrates a partially powered state in which electric power is supplied only to the first resistance heating element from a 100-V power supply. In this example, the apparatus is in a first failed state in which some failure occurs in the relay RL2 and the relay RL2 remains in the OFF state without being capable of turning on, and thus a current flows only through the heating resistor pattern H1 located on an upstream side of the heater 300. In this first failed state, only the single 20-Ω resistor is connected to the 100-V power supply, and thus the current supplied to the heater 300 is equal to 5 A and the electric power is equal to 500 W. In this state, the current detection unit 205 detects that current I1=5 A. That is, the first failed state is defined as a partially powered state in which a current flows only through a conduction path (including the resistance heating element H1 in this specific example) monitored by the current detection unit 205. In the first failed state, unlike the second operation mode shown in FIG. 3C in which electric power of 1000 W is supplied to the heater 300, low electric power of only 500 W is supplied to the heater 300 although the current I1=5 A detected by the current detection unit 205 is the same as in the second operation mode.

FIG. 6B illustrates a partially powered state in which electric power is supplied only to the second resistance heating element from a 100-V power supply. In this state, the connector C1 is in an open state, and thus a current flows only through the heating resistor pattern H2 located on a downstream side of the heater 300. That is, FIG. 6B illustrates the second failed state. In this second failed state, only the 20-Ω resistor is connected to the 100-V power supply, and thus the current supplied to the heater 300 is equal to 5 A and the electric power is equal to 500 W. In this case, the current detection unit 205 detects that current I1=0 A. That is, the second failed state is defined as a partially powered state in which a current flows only through a conduction path (including the resistance heating element H2 in this specific example) that is not monitored by the current detection unit 205. In this second failed state, although I1=0 A is detected by the current detection unit 205, electric power of 500 W is supplied to the heater 300.

Figure 7:
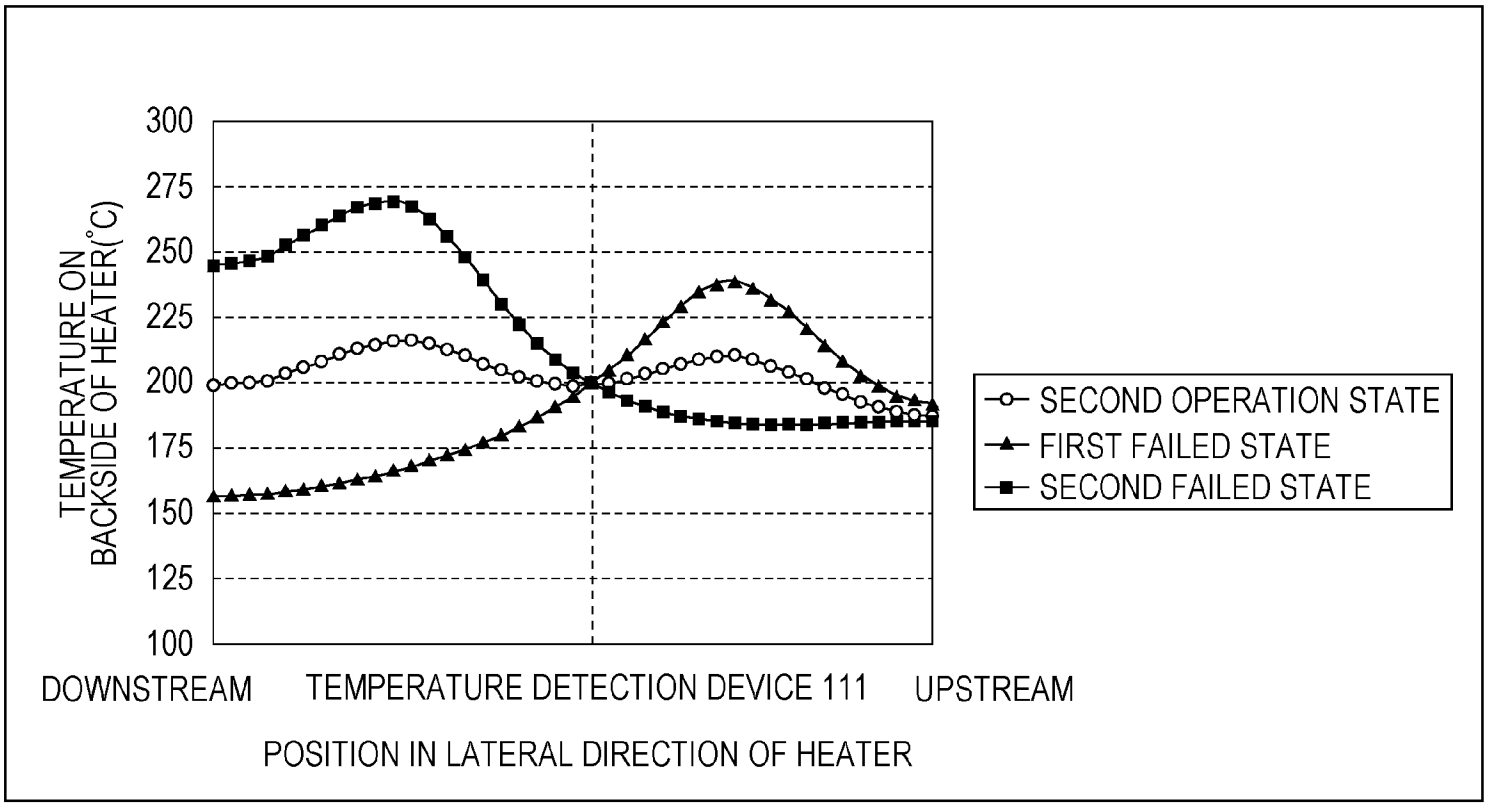
FIG. 7 is a diagram illustrating heat distributions in a normal state, a first failed state, and a second failed state.

FIG. 7 illustrates temperature distributions on the back side of the heater 300 in a lateral direction of the heater 300 for three states: the second operation mode, the first failed state, and the second failed state. These temperature distributions are obtained as a result of simulation performed assuming that the heater temperature is controlled such that the temperature detecting device 111 detects a temperature of 200° C. and the pressure roller 108 is being rotated. Note that the temperature detecting device 111 is located at the center (denoted by a vertical dotted line in FIG. 7) in the lateral direction of the back side of the heater.

In the second operation mode in which heat is equally generated by the upstream heating resistor pattern H1 and the downstream heating resistor pattern H2, the temperature on the back side of the heater is distributed uniformly. In contrast, in the first failed state and the second failed state, the heat distribution is asymmetric unlike the second operation mode in which the heat distribution is symmetric.

In the first failed state in which electric power is supplied only to the part on the upstream side in the rotation direction of the pressure roller 108, the heat distribution is less asymmetric than in the second failed state in which electric power is supplied only to the part on the downstream side. This is because heat is transferred in the rotation direction of the pressure roller 108 (in a direction from the upstream side to the downstream side). Therefore, the reduction in performance of the fixing apparatus in the second failed state is likely to be greater than in the first failed state. This means that, in the failure detection, priority is to be given to detecting the second failed state.

In the second failed state shown in FIG. 6B, although the current I1 detected by the current detection unit 205 is 0 A, electric power of 500 W is supplied to the heater 300 and thus the temperature detecting device 111 detects a finite value, which makes it possible to easily detect the partially powered state. As can be seen from the above discussion, when only a single current detection unit is used to detect the second failed state in which electric power is supplied only to the resistance heating element H2 located on the downstream side, it is more advantageous to dispose the current detection unit 205 so as to detect the current I1 flowing through the resistance heating element H1 located on the upstream side.

Figure 8:
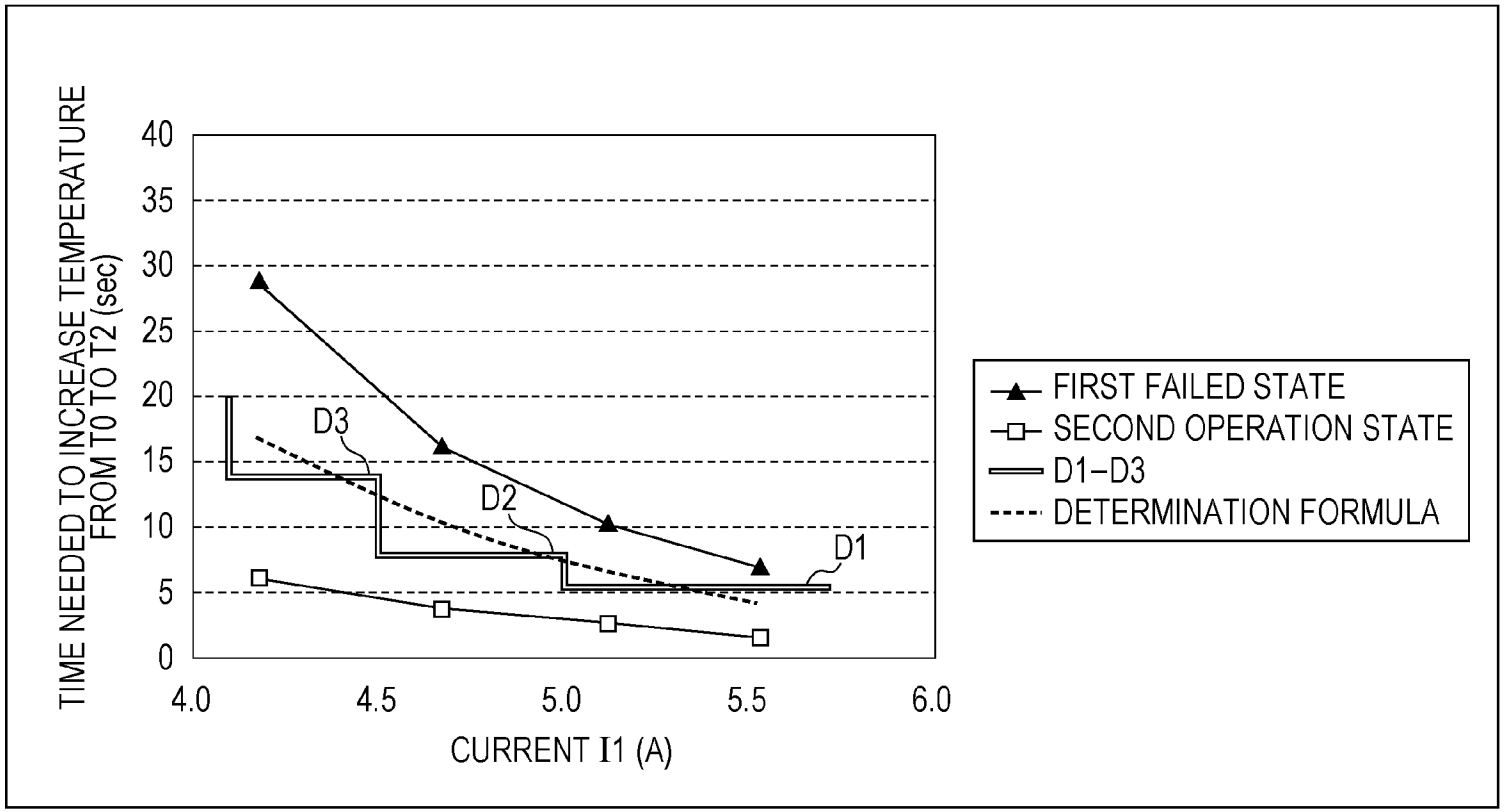
FIG. 8 is a diagram illustrating a method of detecting a partially powered state according to an embodiment of the invention.

In FIG. 8, the time needed for temperature to reach a target temperature T2 from an initial temperature T0 (room temperature (25° C.) in the present example) of the heater is plotted as a function of the current I1. Referring to FIG. 8, a method of detecting the first failed state shown in FIG. 6A is described below. The electric power supplied to the heater 300 is proportional to the square of the current. Therefore, the time needed for the heater to reach a target temperature decreases with the current I1.

As described above with reference to FIG. 6A, the electric power supplied to the heater 300 in the first failed state is one-half the electric power in the second operation mode although the same value of current I1 is detected in both cases. This means that in the first failed state although the same current I1 is detected by the current detection unit 205 as in the second operation mode, it takes a longer time for the heater to reach the target temperature (i.e., the temperature detected by the temperature detection unit increases at a lower rate). Thus it is possible to detect the partially powered state in the first failed state from the current I1 and the temperature detected by temperature detecting device 111 in accordance with criteria D1 to D3 described below.

In FIG. 8, a double-line indicates failure criteria (threshold time values) D1 to D3 for determining the failed state according to the present embodiment. Note that in the failure criteria D1 to D3 described below, 5 A, 4.5 A, and 4.1 A are threshold current values, and 5.8 seconds, 8 seconds, and 14 seconds are threshold time values.

D1: I1≥5 A and the time needed for temperature to reach T2 from T0≥5.8 seconds

D2: I1≥4.5 A and the time needed for temperature to reach T2 from T0≥8 seconds

D3: I1≥4.1 A and the time needed for temperature to reach T2 from T0≥14 seconds

In the graph shown in FIG. 8, an area above the criteria D1 to D3 indicates the first failed state, while an area below the criteria D1 to D3 indicates the second operation state.

In the present embodiment, no determination as to the failure is performed in a rage of I1<4.1 A, because if the first failed state occurs when I1<4.1 A, the electric power supplied to the heater 300 becomes extremely low, and the temperature detected by the temperature detecting device 111 during a normal printing operation becomes extremely low. Therefore, the failed state can be easily detected without using the failure detection method according to the present embodiment. The determination as to the failed state may be performed according to a mathematical determination formula shown below:

$$\text{time needed for temperature to reach } T2 \text{ from } T0 \geq 1100 \times \exp(-I1)$$

This determination formula is represented by a dotted line in FIG. 8.

Figure 9:
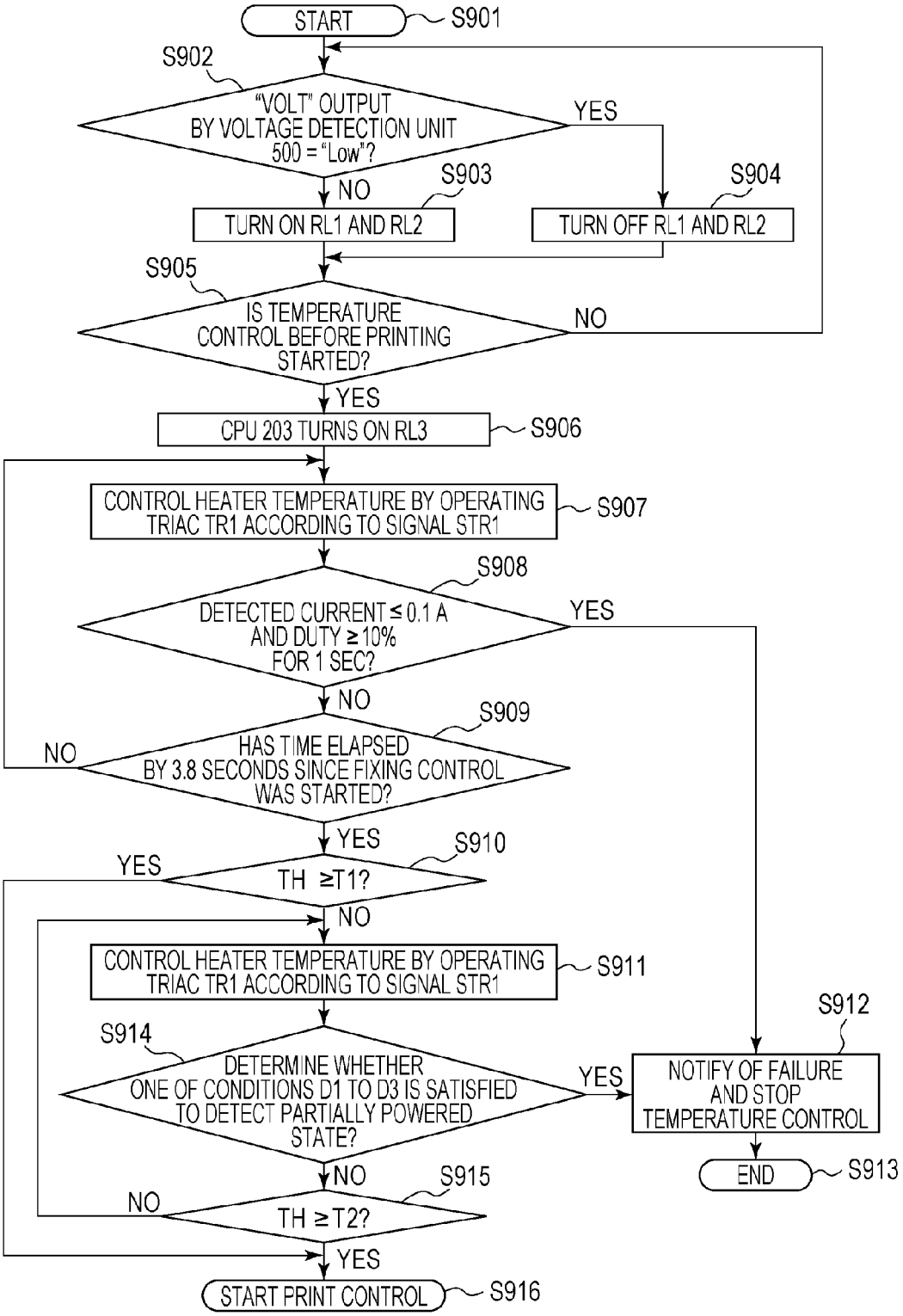
FIG. 9 is a flow chart of a process of detecting a partially powered state according to an embodiment of the invention.

FIG. 9 is a flow chart illustrating a failure detection process performed before printing is started. In the present embodiment, a determination as to whether there is a failure in the fixing unit is performed during a period in which the temperature of the heater is raised from room temperature (T0=25° C.) to the target temperature (T2) according to the determination formula described above. The time needed for temperature to rise to T2 from T0 increases with a difference between T2 and T0 (i.e., T2−T0). Therefore, different criteria or different determination formulae may be used depending on the difference between T2 and T0. Note that the criteria and the determination formula depend on the structure of the fixing apparatus, and thus the criteria and the determination formula used in the failure detection according to the present embodiment are not limited to those described above. In the embodiment described above, the time needed for the temperature detected by the temperature detection unit to reach T2 from T0 is compared with the threshold time value. Alternatively, an increase in temperature during a predetermined time period may be compared with a threshold value. That is, what is to be performed is to compare a rate at which the temperate detected by the temperature detection unit rises with a threshold value (in terms of time or temperature).

As described above, when the temperature increase rate detected by the temperature detection unit is smaller than the threshold rate although the current detected by the current detection unit is greater than the threshold current, the image forming apparatus issues information notifying that there is a failure or stops operating.

The process performed by the CPU 203 to determine whether the fixing apparatus 100 has a failure according to the present embodiment is described in further detail below with reference to the flow chart shown in FIG. 9.

In step S901, the control circuit 200 starts its control operation. In step S902, the range of the power supply voltage is determined based on a signal VOLT output from the voltage detection unit 500. If the power supply voltage is in the 100-V range, then the process proceeds to step S903. On the other hand, if the power supply voltage is in the 200-V range, the process proceeds to step S904. In step S903, the relays RL1 and RL2 are turned on, and the process proceeds to step S905. In step S904, the relays RL1 and RL2 are turned off, and the process proceeds to step S905. The process from steps S902 to S904 is performed repeatedly until it is determined in step S905 that a pre-printing temperature control operation has been started. If the pre-printing temperature control operation is started, the process proceeds to step S906.

In step S906, the relay RL3 is turned on. In step S907, in accordance with a TH signal output from the temperature detecting device 111 and a signal Irms1 output from the current detection unit, the CPU 203 controls the triac TR1 by the PI control scheme to control the electric power supplied to the heater 300 (by controlling the phase of the wavenumber).

In step S908, a determination is performed as to whether electric power with a duty equal to or greater than 10% is being supplied to the heater and the Irms1 signal output from the current detection unit 205 indicates that the current is equal to or lower than a predetermined value continuously for one second. If the determination in step S908 is affirmative, then the CPU 203 determines that the fixing apparatus 100 is in the second failed state described above with reference to FIG. 6B. In this case, the process proceeds to step S912. In step S912, a notification of the failed state is issued and the temperature control operation is stopped. Then in step S913, the process is ended.

In step S909, a determination is performed as to whether an elapsed time since the start of the temperature control operation in step S907 is equal to or greater than 3.8 seconds. In step S910, a determination is performed as to whether the TH signal output from the temperature detecting device 111 is equal to or greater than T1. If TH≥T1, the CPU 203 determines that sufficient electric power is being supplied to the fixing apparatus, and the CPU 203 advances the process to step S916 to start a print control operation. If the fixing apparatus is in the first failed state, the electric power is one-half the electric power in the normal state (in the first or second operation mode), and thus the temperature does not reach T1 in 3.8 seconds after the heater temperature control operation is started. In a case where the result of the determination in step S910 is negative as to whether TH≥T1, the CPU 203 determines that sufficiently large electric power is not supplied to the fixing apparatus. In this case, the process is proceeds to step S911 to continue the pre-printing heater temperature control operation.

In step S914, according to the criteria D1 to D3, a determination is performed as to whether the fixing apparatus 100 is in the first failed state described above with reference to FIG. 6A. The criteria D1 to D3 are described again below.

D1: I1≥5 A and the time needed for temperature to reach T2 from T0≥5.8 seconds D2: I1≥4.5 A and the time needed for temperature to reach T2 from T0≥8 seconds D3: I1≥4.1 A and the time needed for temperature to reach T2 from T0≥14 seconds If it is determined in step S914 that one of criteria D1 to D3 is satisfied, then it is determined that the fixing apparatus 100 is in the first failed state described above with reference to FIG. 6A, and the process proceeds to step S912. In step S912, a notification of the failed state is issued and the temperature control operation is stopped. Then in step S913, the process is ended.

In step S915, a determination is performed as to whether the TH signal output from the temperature detecting device 111 indicates that the temperature is equal to or higher than T2 (T2≥T1). If it is determined that TH≥T2, the CPU 203 determines that electric power sufficiently high to start printing is being supplied to the heater, and the CPU 203 advances the process to step S916 to start the print control operation.

As described above, in the fixing apparatus capable of switching the resistance of the heater, the control unit 200 performs the process according to the flow shown in FIG. 9 to determine whether the fixing apparatus is in the partially powered state. This makes it possible to increase the reliability of the fixing apparatus using the simple configuration described above.

Second Embodiment

Figure 10:
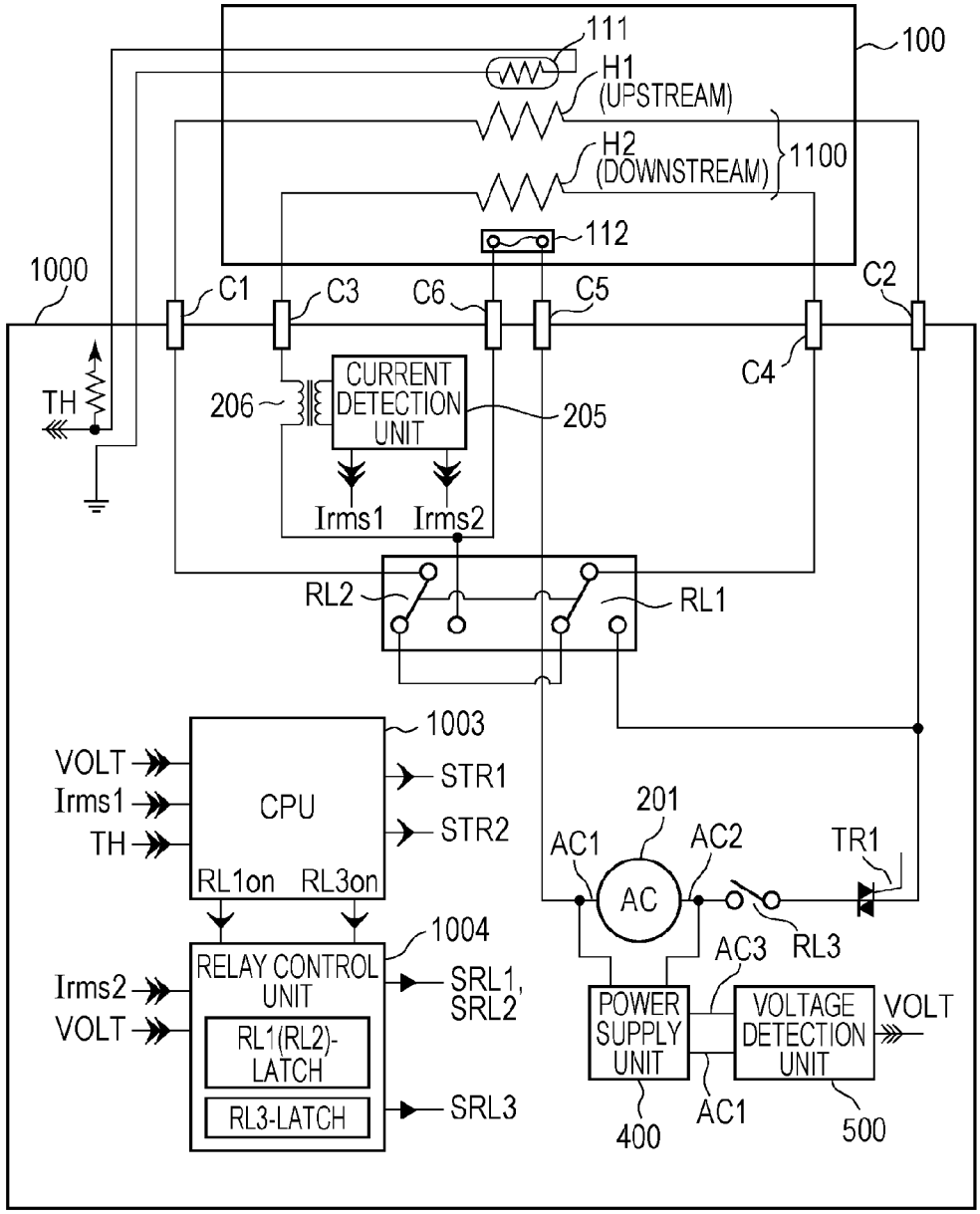
FIG. 10 is a diagram illustrating a heater control circuit according to an embodiment of the invention.

A second embodiment is described below. A further description of similar parts to those in the first embodiment is omitted. FIG. 10 illustrates a control circuit 1000 of a heater 1100 according to the present embodiment. In a power off state, relays RL1, RL2, and RL3 are in such states as shown in FIG. 10. The relays RL1 and RL2 are of the break-before-make type. In a case where the voltage detected by the voltage detection unit 500 is in the 200-V power system range, the relay control unit 1004 operates the RL1-latch such that the relay RL1 is maintained in the OFF state. The relay RL2 operates following the relay RL1, and thus the relay RL2 turns off when the relay RL1 turns off. Furthermore, the relay RL3 is turned on. As a result, the fixing apparatus 100 comes to be capable of receiving electric power. In this state, the first resistance heating element H1 is connected in series to the second resistance heating element H2, and thus the heater 1100 is switched into a high resistance state. On the other hand, in a case where the voltage detected by the voltage detection unit 500 is in the 100-V power system range, the relay RL1 is turned on. The relay RL2 operates following the relay RL1, and thus the relay RL2 turns on when the relay RL1 turns on. Furthermore, the relay RL3 is turned on. As a result, the fixing apparatus 100 comes to be capable of receiving electric power. In this state, the first resistance heating element H1 and the second resistance heating element H2 are connected in parallel, and thus the heater 1100 has a low resistance.

Figure 11:
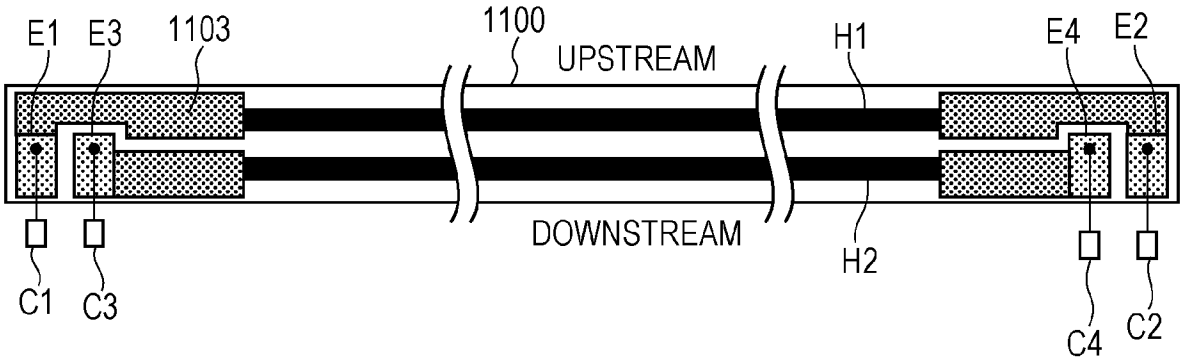
FIG. 11 is a diagram illustrating a structure of a heater according to an embodiment of the invention.

FIG. 11 illustrates a structure of the heater 1100. In this example, the heater 1100 includes a first resistance heating element H1 (on an upstream side) and a second resistance heating element H2 (on a downstream side). In this heater 1100, electric power is supplied to the first resistance heating element H1 via electrodes E1 and E2, while electric power is supplied to the second resistance heating element H2 via electrodes E3 and E4. The electrode E1 is connected to the connector C1, the electrode E2 is connected to the connector C2, the electrode E3 is connected to the connector C3, and the electrode E4 is connected to the connector C4. In the second embodiment, a determination is performed in step S908 in FIG. 9 as to whether an upstream-side partially powered state occurs in which a current is supplied only to the resistance heating element H1, while a determination is performed in step S914 in FIG. 9 as to whether a downstream-side partially powered state occurs in which a current is supplied only to the resistance heating element H2. Note that the process of detecting the partially powered state in step S914 according to the first embodiment described above may be used not only to detect the partially powered state on the upstream side but also to detect the partially powered state on the downstream side. Furthermore, the method described above may also be applied to the fixing apparatus having the control circuit 1000 capable of switching the resistance of the heater using the two relays of the break-before-make type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. Values disclosed herein for temperature, resistance, current, voltage and power, for example, are exemplary values and primarily for teaching purposes. Different values of temperature, resistance, current, voltage and power may be used and satisfy relational and functional requirements as disclosed herein.

This application claims the benefit of Japanese Patent Application No. 2010-273894 filed Dec. 8, 2010, which is hereby incorporated by reference herein in its entirety.

What is claimed is:

1. An image forming apparatus comprising:

an image forming unit configured to form an image on a recording sheet; and a fixing unit comprising;

an endless belt;

a heater including a first resistance heating element and a second resistance heating element, the first and second resistance heating elements formed on a substrate and being in contact with an inner surface of the endless belt;

a nip forming element that forms, together with the heater via the endless belt, a fixing nip for nipping and conveying a recording sheet having an image formed thereon, and a temperature detection unit that detects a temperature of the heater, the fixing unit capable of switching between a first operation mode in which the first resistance heating element and the second resistance heating element are connected in series and a second operation mode in which the first resistance heating element and the second resistance heating element are connected in parallel, wherein the image forming apparatus further comprises a current detection unit disposed in a conduction path after branching toward the first resistance heating element and the second resistance heating element in a parallel connecting state, wherein if a temperature increase rate detected by the temperature detection unit is less than a threshold rate, although a current detected by the current detection unit is greater than a threshold current, a notification of a failure is issued or a driving operation of the apparatus is stopped, and wherein the first resistance heating element is disposed on an upstream side in a recording sheet conveying direction with respect to the second resistance heating element, and the current detection unit detects a current in the first resistance heating element.

2. The image forming apparatus according to claim 1, further comprising a voltage detection unit configured to detect a voltage of a commercial power supply, wherein the switching between the first operation mode and the second operation mode is automatically performed depending on the voltage detected by the voltage detection unit.

3. The image forming apparatus according to claim 1, wherein the first resistance heating element is provided between a first electrode and a third electrode and the second resistance heating element is provided between a second electrode and the third electrode, wherein the apparatus further comprises a first switch unit provided between the third electrode and a first output terminal of an AC power supply, and a second switch unit provided on a power supply path so as to switch whether the second electrode is connected to the first output terminal of the AC power supply or a second output terminal of the AC power supply, and wherein the current detection unit is provided between the first electrode and the second output terminal of the AC power supply.

4. An image forming apparatus comprising:

an image forming unit configured to form an image on a recording sheet;

a fixing unit comprising;

a heater including a first resistance heating element and a second resistance heating element; and a temperature detection unit that detects a temperature of the heater, the fixing unit capable of switching between a series connecting state in which the first resistance heating element and the second resistance heating element are connected in series and a parallel connecting state in which the first resistance heating element and the second resistance heating element are connected in parallel, a current detection unit disposed in a conduction path after branching toward the first resistance heating element and the second resistance heating element in the parallel connecting state, and a controller;

wherein if a temperature increase rate detected by the temperature detection unit is less than a threshold rate, although a current detected by the current detection unit is greater than a threshold current, the controller issues a notification of a failure or stops a driving operation of the apparatus, wherein the first resistance heating element is provided between a first electrode and a third electrode and the second resistance heating element is provided between a second electrode and the third electrode, wherein the apparatus further comprises a first switch unit provided between the third electrode and a first output terminal of an AC power supply, and a second switch unit provided on a power supply path so as to switch whether the second electrode is connected to the first output terminal of the AC power supply or a second output terminal of the AC power supply, and wherein the current detection unit is provided between the first electrode and the second output terminal of the AC power supply.

5. The image forming apparatus according to claim 4, wherein the first resistance heating element is disposed on an upstream side in a recording sheet conveying direction with respect to the second resistance heating element.

6. The image forming apparatus according to claim 4, further comprising a voltage detection unit configured to detect a voltage of an AC power supply, wherein the switching between the series connecting state and the parallel connecting state is automatically performed depending on the voltage detected by the voltage detection unit.

7. The image forming apparatus according to claim 4, wherein the fixing unit further comprises an endless belt.

8. The image forming apparatus according to claim 7, wherein the first resistance heating element and the second resistance heating element are formed on a heater substrate made of ceramic, and wherein the heater contacts with an inner surface of the endless belt.

* * * * *